United States Patent [19]

Barnes

[11] 4,241,335

[45] Dec. 23, 1980

[54] AUTOMATICALLY SUPERVISED ALARM SYSTEM

[75] Inventor: Brian S. Barnes, Birmingham, England

[73] Assignee: Modern Automatic Alarms Limited, London, England

[21] Appl. No.: 919,032

[22] Filed: Jun. 26, 1978

[51] Int. Cl.[3] ..... G08B 13/22

[52] U.S. Cl. ..... 340/507; 340/506; 340/527; 340/511

[58] Field of Search ..... 340/505, 506, 507, 511, 340/527, 531, 558, 565, 566

[56] References Cited

U.S. PATENT DOCUMENTS 2,779,936 1/1957 Loudon et al. ..... 340/511

*Primary Examiner*—Alvin H. Waring

*Attorney, Agent, or Firm*—Berman, Aisenberg & Platt

[57] ABSTRACT

An alarm system including an alarm which is actuated when a sensor such as a microphone detects an emergency condition. In one embodiment the output of the microphone is fed through a filter circuit tuned to frequencies characteristic of breaking glass. In conventional systems failure of the microphone may remain undetected but in the system of the present invention an alarm is instituted when the sensor detects any emergency signals and when the sensor fails to detect a reference signal. The reference signal is produced at regular intervals but the alarm instituting means includes a delay and is operable to switch off the reference signal within the delay period to avoid false alarms.

9 Claims, 3 Drawing Figures

AUTOMATICALLY SUPERVISED ALARM SYSTEM

Figure 1:
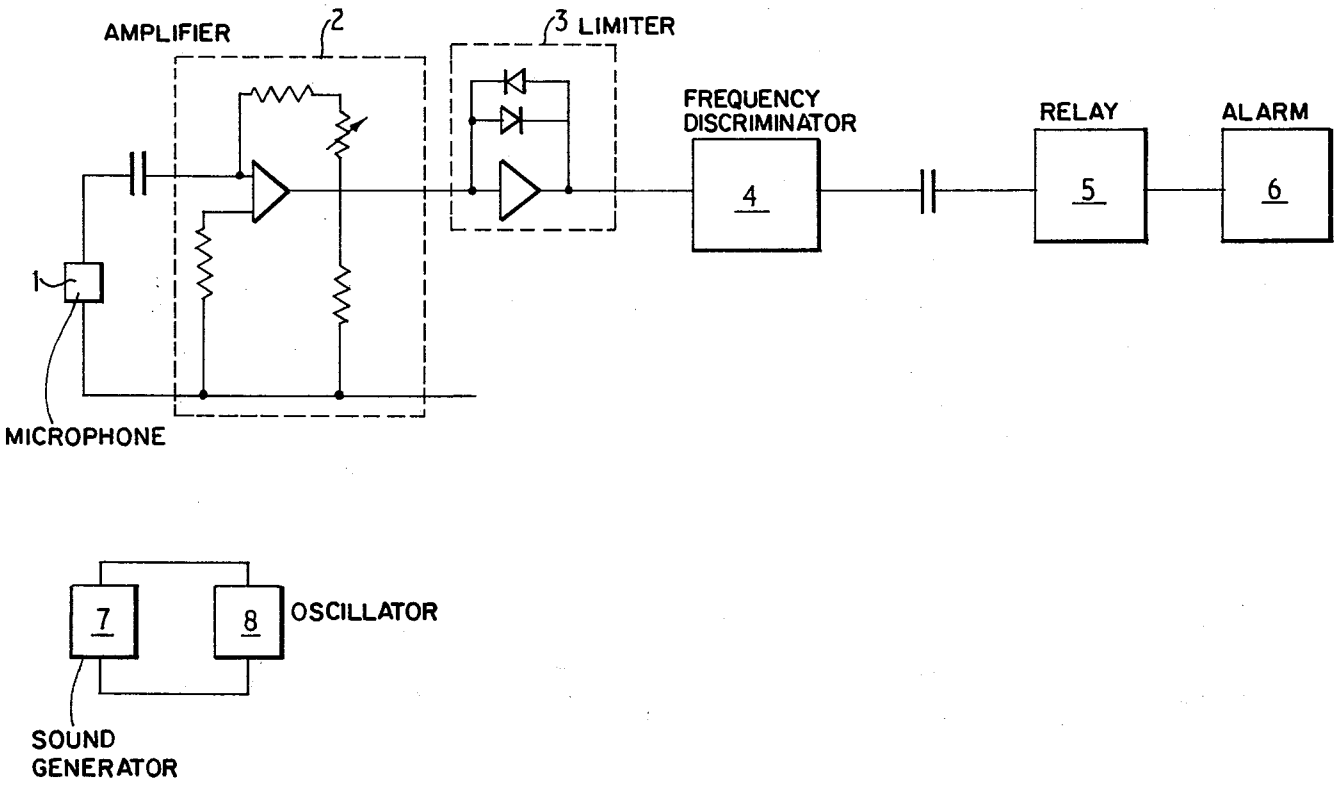

This invention relates to an alarm system comprising a sensor and means for actuating an alarm when the sensor detects a signal which is characteristic of some emergency condition.

In one known burglar alarm system of this type the sensor is a microphone whose output is fed to a filter circuit tuned in such a way that it only passes frequencies which are characteristic of breaking glass. This system works very well but does have a problem in that any failure of the microphone may remain undetected until after a burglary has been committed. The invention arose in an attempt to deal with this problem.

According to this invention an alarm system comprises a sensor for detecting a signal which is characteristic of some emergency condition, a signal generator and means for instituting an alarm when the sensor detects a signal which is characteristic of an emergency and when the sensor fails to detect a signal characteristic of the generator.

In one particular form of the invention the sensor is a microphone and the signal generator is a sound-producing element. The output of the microphone is fed to a filter circuit which identifies the presence (or absence) of frequencies from the signal generator and of frequencies which are characteristic of some occurrence which the system is watching for, e.g. breaking glass.

Preferably, the generator signal is of the same frequency as the signal characteristic of the emergency condition of interest and the generator emits a signal at regular intervals. To avoid causing an alarm, however, the alarm instituting means includes a delay and is operable following the detection of a signal to switch off the generator signal within the delay period. There is also a switch circuit including a relay or the like, responsive in the absence of a detection by the sensor at regular intervals, to cause an alarm.

An optional feature is the inclusion of a second microphone, spaced from the first mentioned microphone. The output of the microphones can then be processed by suitable circuitry so that the alarm is actuated only when the ratio of the amplitudes of sound received at the respective microphones is equal to a preset value or between preset limits. In this way the system is made directional so that it can be set, for example, to respond to the sound of breaking glass only when emanating from the direction of a window.

This idea of providing for directional sensitivity of the system can be useful in systems which are otherwise conventional ie. which do not incorporate the signal generator and the means for instituting an alarm when the sensor fails to detect a signal from the generator. Therefore there is a second aspect to this invention.

Accordingly one embodiment of the invention comprises two spaced sensors the means for instituting the alarm being controlled by a comparator for comparing the outputs of the sensors, so that only signals derived from a particular region or regions are operative to actuate the alarm.

Three exemplary embodiments of an alarm system according to this invention will now be described with reference respectively to FIGS. 1 to 3 of the accompanying drawings, each of which is a circuit diagram.

FIG. 1 shows an alarm system comprising a magnetic microphone 1. The output of the microphone is amplified by the amplifier 2 and is then passed to a voltage limiter 3 the purpose of which is to regulate the voltage of the signal to a preset value.

The signal is then passed to a discriminating circuit 4 which defines a window of between 5 and 6.5 KHZ, frequencies between these values being allowed to pass to a relay 5 which controls some alarm device 6.

A sound generator 7 is driven by an oscillator 8 operating at 19 KHZ, i.e. above the audible range.

The system operates as follows. In the normal activated state of the system the oscillator 8 causes the generator 7 to produce a 19 KHZ signal. This is sensed by the microphone and is allowed to pass through the discriminating circuit 4, to hold the relay open. The alarm therefore remains dormant. Should the microphone or amplifier fail, the 19 KHZ signal will no longer reach the relay which will close, causing the alarm to be actuated.

When the microphone senses a frequency of between 5 and 6.5 KHZ, these frequencies being characteristic of breaking glass, the microphone output is also allowed to pass to the relay 5 which is caused to close in response to these frequencies. In these circumstances the alarm is also actuated.

In a directionally sensitive version (not shown) an additional microphone is included and the output amplitude of this is compared with the output amplitude of the microphone 1. Only if the ratio of the amplitudes is within a predetermined range is the 5 to 6.5 KHZ signal passed onto the next stage of the circuit. In another arrangement it would be possible to compare the phases rather than the amplitudes of the signals.

Figure 2:
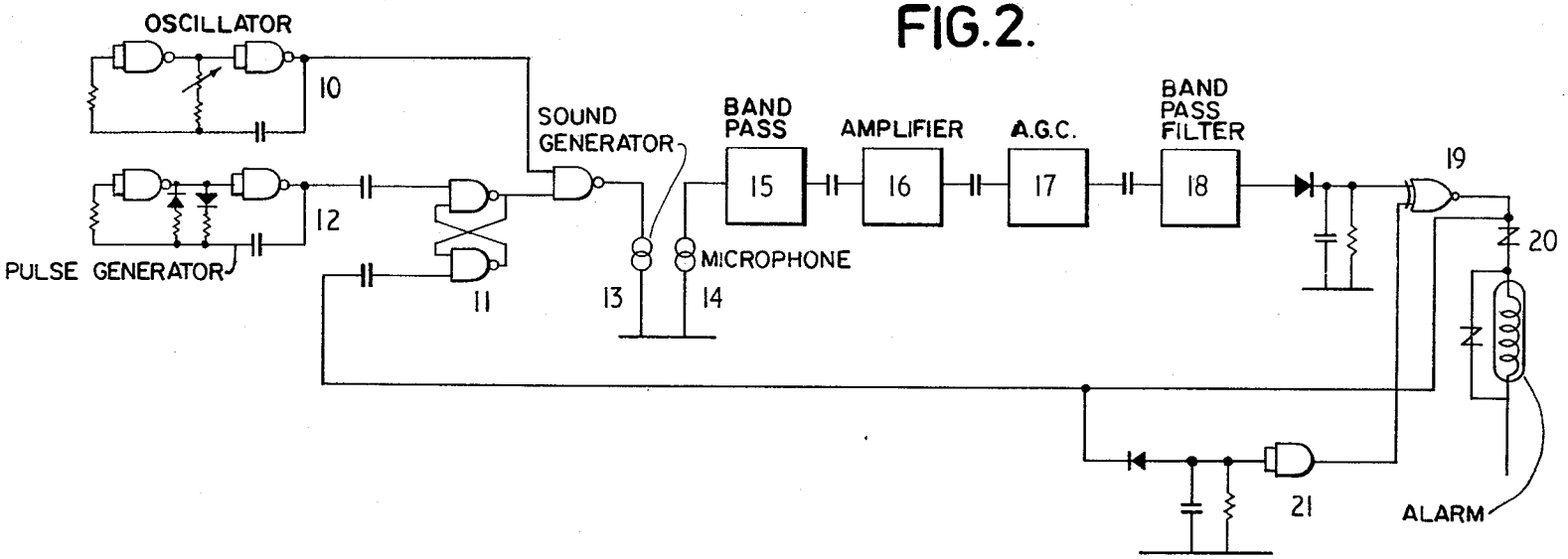

In an alternative device shown in FIG. 2 a continuously operating oscillator 10 produces a signal whose frequency is the same as the characteristic frequency of the emergency to be detected. In this particular embodiment this is the 5 to 6.5 KHZ frequency characteristic of breaking glass.

A needle-pulse generator 12 produces a pulse at fixed intervals of time and each pulse is applied to an input of a bistable memory 11 which changes state thereby allowing oscillations from oscillator 10 to actuate a device 13 which produces an audible sound.

A microphone 14 detects the sound and converts it into electrical oscillations which are passed to a first stage band pass 15, an amplifier 16, an automatic gain control 17, a band pass filter 18, and a gate 19 to a warning device 20. However the warning device 20 does not respond instantaneously.

The signal at the output of gate 19 is applied to the bistable device 11 which reverts to its original condition thereby switching off the oscillator 10. The signal at the output of gate 19 therefore ceases before the device 20 has had time to respond.

The signal at the output of gate 19 is also applied to a circuit 21 which is held in an active state providing it receives a signal at regular intervals as defined by the pulse generator 12. Should a signal be absent due to a fault on the circuitry or in components 13 or 14, the circuit 21 will assume a passive state and this will cause the device 20 to be actuated via gate 19.

A sound produced externally of the device is detected by microphone 14 and, if the correct frequency is present and is of the required duration, the device 20 is actuated.

Figure 3:
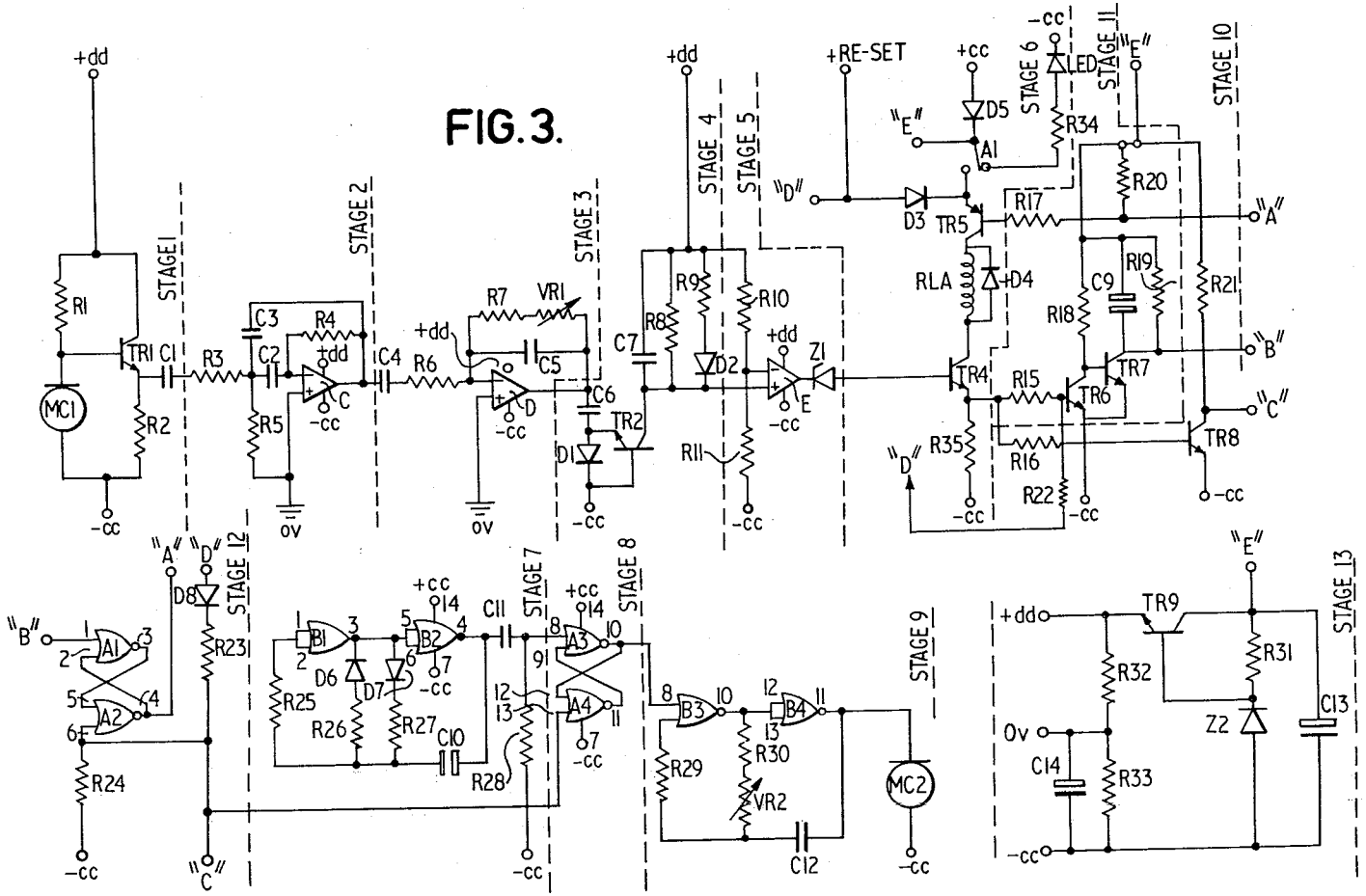

FIG. 3 is made up in three parts namely 3*a*, 3*b* and 3*c*, interconnections between the various parts of the circuit being indicated by designating those terminals which are interconnected with a common reference letter or letters. This embodiment is similar to the embodiment of FIG. 2 except as regards the actuation of the alarm device. The circuit is conveniently divided into stages and in the following reference will be made to such, the stages being indicated by dotted lines in FIG. 3.

Microphone MC1 forms part of the input stage 1 and is connected to an emitter follower producing a low output impedance. The output from the base of transistor TR1 is passed to a filter stage 2. This filter has a fixed centre frequency of 6.5 KHZ and as can be seen from the figure is a second order active filter. Its output passes to a variable gain amplifier stage 3 with a high frequency cut off determined by the capacitor C5, and thence to a low frequency cut-off stage 4. When the signal at input to stage 4 rises above 4.5 KHZ a negative voltage is developed at the emitter of TR2 which allows TR2 to conduct each negative half cycle thereby driving down the voltage across C7. The effect of this stage is to avoid actuation of the alarm by very low frequency noise.

Stage 5 is) a Schmitt trigger which is connected to a final relay stage 6. R10 and R11 form a potential divider providing a reference voltage V ref while the input voltage of the Schmitt trigger is high the output also remains high and holds on the relay switch in stage 6. When a 6.5 KHZ signal is received, stage 4 presents a low input voltage. If this voltage is below V ref the output of stage 5 goes low and switches off TR4 so that the relay drops out and produces an alarm. Once the normally open contact A, in stage 6, is closed the relay contact acts as a latch to prevent re-energization of the relay until a positive potential is applied to the RESET terminal.

The monitoring circuit is made up of stages 7 to 14. A free running pulse generator stage 7 produces a non-symmetrical waveform which passes to an integrator (C11 and R28) which emits a short pulse to switch the bistable stage 8 output high and drive a tone generator stage 9. A variable resistor VR2 is used to adjust the frequency of a symmetrical square wave output supplied to the second microphone MC2.

The tone emitted by microphone MC2 is detected by microphone MC1 and initiates the switching off TR4. However, before the relay drops out to indicate an alarm, the tone detector stage 10 resets the bistable stage 8 and switches off the test tone when TR4 is switched on, the voltage dropped across R35 switches on TR8 which generates a 'LOW' output. The instant TR4 is switched off TR8 switches off and the output goes high to reset the tone generator bistable cancelling the test tone.

Transistors TR6 and TR7 in a test pulse detector stage 11 are used to recharge capacitor C9 each time a test pulse is received, whilst the capacitor slowly discharges through resister R19. If the tone transmitter stage fails to operate or another fault occurs, C9 discharges and the potential at terminal B rises toward V+cc. At a predetermined voltage the output B switches over a bistable circuit in the circuit failure cut-off stage 12, which switches off the relay through transistor TR5. This bistable is reset by a positive potential applied at terminal D from an external, remote reset button. Terminal C also resets the bistable of stage 8.

While the reset button is held R22 prevents resetting of the tone generator by transistor TR8. If the reset button is held, therefore, the test tone continues cancelling the detector to operate via TR4. The power supply is controlled to avoid large fluctuations, by stage 13 which includes a zoner diode Z2 operating in the avalanche region.

It is to be understood that the illustrated embodiments of the invention have been described only for the purpose of example and that many varients are possible. For example in the circuit of FIG. 1 the microphone 1 could be replaced by a photodetector for the purpose of fire detection. The device 7 would then be replaced by a light-source arranged to flicker at a frequency different from the frequencies which are characteristic of fires. The frequencies passed by the discriminating circuit are of course chosen according to the particular occurrence which the system is designed to detect. Similar modifications could be made in the circuit of FIG. 2.

What we claim is:

1. An alarm system comprising two spaced sensors for detecting a signal which is characteristic of a predetermfined emergency condition; a signal generator; and means for instituting an alarm when the sensor detects a signal which is characteristic of an emergency and when the sensor fails to detect a signal characteristic of the generator; said means for instituting an alarm being controlled by a comparator for comparing the outputs of said two sensors, so that only signals derived from a particular region or regions are operative to actuate the alarm.

2. An alarm system according to claim 1 wherein said sensors are microphones, the signal generator being a sound producing element.

3. An alarm system according to claim 1 wherein the outputs of the sensors are fed to filter circuit means for identifying the presence of frequencies which are characteristic of the emergency condition.

4. An alarm system according to claim 3 wherein the filter circuit is arranged to identify frequencies of between 5 and 6.5 KHZ.

5. An alarm system according to claim 1 wherein the generator signal is of the same frequency as the signal characteristic of the emergency condition of interest.

6. An alarm system according to claim 5 wherein the generator emits a signal at intervals and wherein the alarm instituting means includes a delay and is operable following the detection of a signal to switch off the generator signal within the delay period so that the generator signal does not cause an alarm.

7. An alarm system comprising a sensor for detecting a signal which is characteristic of a predetermined emergency condition; a signal generator means for emitting at intervals, a signal of the same frequency as the signal characteristic of the emergency condition of interest; and means for instituting an alarm when the sensor detects a signal which is characteristic of an emergency and when the sensor fails to detect a signal characteristic of the generator means; wherein said alarm instituting means includes a delay and is operable following the detection of a signal to switch off the generator signal within the delay period so that the generator signal does not cause an alarm and wherein said alarm instituting means further includes a switch circuit including a relay or the like, responsive in the absence of a detection by the sensor at regular intervals, to cause an alarm.

8. An alarm system comprising a sensor for detecting a signal which is characteristic of a predetermined emergency condition; signal generating means for emitting a signal of the same frequency as the signal characteristic of the emergency condition of interest; and wherein the generator is switched by a bistable circuit which is set at regular intervals to emit a generator signal and reset to switch off the generator signal upon detection of the signal by the sensor and wherein the alarm instituting means comprises an active circuit including a relay which drops out to cause an alarm in the absence of a detection by the sensor at regular intervals, the bistable circuit being resettable within a delay period determined by the time taken for operation of the relay so that the generator signals do not cause an alarm.

9. An alarm system according to claim 7 or claim 8 and comprising two spaced sensors wherein the means for instituting the alarm is controlled by a comparator for comparing the outputs of the sensors, so that only signals derived from a particular region or regions are operative to actuate the alarm.

* * * * *